US008122968B2

(12) United States Patent
Johnson

(10) Patent No.: US 8,122,968 B2
(45) Date of Patent: Feb. 28, 2012

(54) FIRE SUPPRESSION SYSTEM

(75) Inventor: Gary L. Johnson, Cape Charles, VA (US)

(73) Assignee: Lubrizol Advanced Materials, Inc., Cleveland, OH (US)

( * ) Notice: Subject to any disclaimer, the term of this patent is extended or adjusted under 35 U.S.C. 154(b) by 1018 days.

(21) Appl. No.: 11/687,279

(22) Filed: Mar. 16, 2007

(65) Prior Publication Data

US 2007/0221388 A1 Sep. 27, 2007

Related U.S. Application Data

(60) Provisional application No. 60/784,565, filed on Mar. 22, 2006.

(51) Int. Cl.
*A62C 37/36* (2006.01)

(52) U.S. Cl. ..... 169/16; 169/17; 169/19; 169/23; 169/60; 169/46

(58) Field of Classification Search ..... 169/37, 169/17, 19, 23, 60, 46, 16; 138/143
See application file for complete search history.

(56) References Cited

U.S. PATENT DOCUMENTS

| | | | | |
|---|---|---|---|---|
| 2,222,365 | A * | 11/1940 | Edmundson | 169/12 |
| 4,058,167 | A | 11/1977 | Granek et al. | |
| 4,453,155 | A | 6/1984 | Cooper | |
| 4,991,657 | A * | 2/1991 | LeLande, Jr. | 169/46 |
| 5,236,049 | A | 8/1993 | Asselin et al. | |
| 5,263,543 | A * | 11/1993 | Nigro | 169/56 |
| 5,769,128 | A * | 6/1998 | Auvil et al. | 138/143 |
| 5,775,378 | A * | 7/1998 | Auvil et al. | 138/143 |
| 5,971,080 | A * | 10/1999 | Loh et al. | 169/43 |
| 5,992,532 | A * | 11/1999 | Ramsey et al. | 169/46 |
| 6,540,261 | B1 * | 4/2003 | Parker et al. | 285/133.11 |
| 6,964,379 | B2 * | 11/2005 | Crowley | 239/208 |
| 2004/0216899 | A1 * | 11/2004 | Crowley | 169/46 |
| 2006/0038029 | A1 | 2/2006 | Rummig et al. | |

FOREIGN PATENT DOCUMENTS

| | | |
|---|---|---|
| EP | 0 650 743 A1 | 5/1995 |
| WO | 2004/082768 A1 | 9/2004 |

* cited by examiner

*Primary Examiner* — Len Tran
*Assistant Examiner* — Trevor E McGraw
(74) *Attorney, Agent, or Firm* — Christopher P. Demas; Samuel B. Laferty; Thoburn T. Dunlap

(57) ABSTRACT

A sprinkler system comprises a network of CPVC conduits and a plurality of sprinklers. The system includes an electrically activated solenoid control valve to allow fluid to flow in the pipe network. One or more fire detectors operate independently of the condition of the sprinklers. Upon detection of an incipient fire situation, a fire detector sends an electrical signal to cause activation of the control valve. Upon activation of the control valve, fire suppression fluid is caused to flow through the conduits before the incipient fire situation matures into a sprinkler-triggering event. The cooling effect of fluid flowing through the conduit enables the conduit to resist structural failure prior to sprinkler deployment. The control valve may be disposed at a remote location in the sprinkler line and be operable as part of an inspector's test connection.

26 Claims, 2 Drawing Sheets

FIRE SUPPRESSION SYSTEM

CROSS REFERENCE TO RELATED APPLICATION

This application claims the benefit of U.S. Provisional Application No. 60/784,565 filed Mar. 22, 2006, and the disclosure thereof is incorporated herein by reference.

TECHNICAL FIELD

The invention relates generally to fire sprinkler systems. More specifically, exemplary embodiments relate to a fire sprinkler system using CPVC pipes that may be installed in an attic or basement environment.

BACKGROUND ART

Sprinkler systems may be employed as a fire suppression measure. A sprinkler head may include a thermally responsive mechanism that operates so that when a fire causes a temperature limit to be reached, the sprinkler head will open and dispense fire extinguishing fluid. In general, fire suppression systems must meet stringent safety standards. Certain fire system standards dictate the placement and spacing of sprinkler heads.

SUMMARY OF INVENTION

The exemplary sprinkler systems discussed in more detail herein may be included in an attic or other setting as a fire suppression measure. If the attic space is not susceptible to freezing temperatures that cause the fire extinguishing fluid to solidify, the system may be a "wet" system in which the fluid conduits constantly contain water or a water-based fire extinguishing fluid at all times so they are ready to deliver fluid to the protected area when a sprinkler head is activated.

The sprinkler systems of exemplary embodiments may be used to achieve satisfactory results in a "small fire test" in which a small fire is set near the eaves of an attic between two sprinkler heads. In the past when the principles of the exemplary embodiments have not been used in such testing, results have sometimes been unsatisfactory. For example, the heat from the small fire could rise and accumulate in the attic peak. After sufficient heat is generated, one or more sprinkler heads in the peak may operate. However, fire extinguishing fluid is discharged only within the covered zone of the open sprinkler heads, and not necessarily in the region of the fire. Only after the fire becomes large enough to build up enough heat to activate a sprinkler close to the fire, will extinguishing fluid be dispensed in the initial fire area. The delay in activation of the local sprinkler may subject thermoplastic sprinkler piping near the initial fire location to the possibility of structural failure due to heat or direct flames.

The sprinkler systems of exemplary embodiments provide fire suppression capabilities that provide more satisfactory results in such a "small fire test". The sprinkler systems also allow more extensive use of thermoplastic pipes, such as CPVC pipes, as the fluid conduits for sprinkler systems. The term "thermoplastic" as used in this specification is intended to include thermoplastic polymers which can be melt processed and formed into pipes. The term thermoplastic includes polymeric materials that are crosslinked after forming into pipes, such as crosslinked polyethylene (PEX), which is traditionally referred to as a thermoset material. The thermoplastic pipes used in this invention also include composite pipes which have at least one metallic layer and at least one thermoplastic layer. CPVC pipes are the most preferred and are widely used in fire sprinkler applications, so the exemplary embodiments will be shown in terms of CPVC pipe, but it being understood that any other thermoplastic pipe could be used, as long as it meet applicable building codes for fire sprinkler applications.

Unfinished residential basements may also present challenges to fire suppression systems. Standards for the construction of such buildings may require that sprinkler heads be disposed a certain distance below the ceiling. However, in unfinished residential basements, the "ceiling" may be absent, with the possibility of being added later. It may be more cost effective to install a fire suppression system prior to "finishing" a basement which includes adding a suspended ceiling which will tend to protect the fluid conduits from heat and flames. The exemplary sprinkler systems discussed herein provide fire suppression capabilities that are able to pass applicable fire system standards, while the basement remains in an "unfinished" state.

Therefore, it is an object of an exemplary embodiment to provide a system that comprises a plurality of lengths of fluid pipe in fluid communication. The exemplary pipes are comprised of a chlorinated polyvinyl chloride ("CPVC") composition. The exemplary system causes a fire extinguishing fluid (e.g., water) to flow through the pipes before the sprinklers are activated, thus providing cooling to maintain the structural integrity of the pipes prior to sprinkler activation. For purposes of this disclosure, fluids that extinguish a fire and/or act to retard the growth of a fire are collectively referred to as fire suppression fluids.

In accordance with one aspect of an exemplary embodiment, one or more sensors are used in conjunction with a sprinkler line formed of CPVC pipes. The sensors are operative to detect an incipient fire situation before it can mature into a more serious thermal event. Upon incipient fire detection, the sensors generate at least one electrical signal that is operative to control at least one flow control valve.

In an exemplary embodiment, a solenoid control valve operates to provide flow in a manner similar to an inspector's test connection. When the valve is activated, fluid flow is initiated so that instead of certain fluid conduits being filled with substantially stationary fire extinguishing fluid, the fire extinguishing fluid flows through the conduits, prior to opening of any sprinkler. In this way, if the incipient fire situation matures into a threshold thermal event, the flowing fluid (acting as a coolant) in the CPVC pipes will prolong the structural integrity of the pipes. If the incipient fire situation causes the temperature adjacent to a sprinkler to reach or exceed the limit for sprinkler activation, the thermally responsive element of the sprinkler will cause the sprinkler to deploy and distribute the fire suppression fluid from the sprinkler line to the fire.

Other exemplary arrangements of valves and sensors may be used so that upon detection of a probable incipient fire situation, a fluid flow event is initiated whereby fluid flows through the sprinkler line, independent of the condition or status of any sprinkler head. Thus, the plastic piping will remain cool long enough to prevent structural failure thereof until after the nearest (or local) sprinklers connected to the piping deploy.

In another exemplary embodiment, one or more sensors can detect an incipient fire situation in an area or region that may not be in a direct distribution path for extinguishing fluid delivered by a sprinkler that becomes activated due to the heat buildup caused by the fire. Because the initially activated sprinkler may be remotely located from the region of the actual fire (e.g., for example, it may be located in an area which collects the most heat), the fire suppression fluid dispensed therefrom will not reach the fire location (nor the piping nearest the fire). However, in exemplary embodiments, if a small fire begins in a location remote from the area where the most heat will accumulate (e.g., an attic eave), a fire, temperature or other sensor can detect the probable fire condition and cause one or more flow valves to be activated, thus initiating coolant flow through the piping nearest the fire. That is, the coolant flow can be initiated prior to any sprinkler activation. If flow of the fluid through the piping were delayed until activation of a sprinkler (or until activation of the sprinkler nearest to the fire), then the heat or flame from the maturing fire could cause structural failure of the piping nearest the fire prior to the sprinkler activation, thus defeating the fire suppression system. As a result, piping needed to extinguish the fire (without the cooling effect of flowing fluid therethrough) may be damaged by the fire if the cooling flow is not initiated prior to the time of sprinkler activation.

For purposes of this disclosure, incipient fire situation comprises a heat source and/or a source of other properties or attributes that can be detected for purposes of identifying a probable fire situation. One or more sensors may be used for sensing at least one of heat, smoke, infrared radiation, and ultraviolet radiation emitted by the fire and for providing one or more electrical signals responsive thereto. Suitable solenoid control valves or other valve types can be activated responsive to the electrical signals provided by the at least one sensor.

In an exemplary system, each of the sprinklers includes a thermally responsive member operative to open the corresponding sprinkler upon exposure to the threshold thermal event. In exemplary embodiments, the region to be protected may be part of an attic space in a building or an unfinished residential basement space.

In exemplary embodiments, a solenoid actuated control valve is disposed at a remote location in fluid communication with the sprinkler line. The solenoid control valve may operate in a manner comparable to an inspector's test connection. An outlet for fire suppression fluid may be provided downstream of the inspector's test connection.

In exemplary embodiments, a method for operation of such a system may include sensing an incipient fire situation with at least one detector operative to sense at least one of heat, smoke, infrared radiation, and ultraviolet radiation emitted by combustion. Responsive to such sensing, the exemplary method may further include enabling fire extinguishing fluid to flow through a sprinkler line comprising one or more CPVC fluid conduits. The exemplary method may further include utilizing the flowing fire extinguishing fluid to maintain the structural integrity of the fluid conduits after sensing the incipient fire situation and before deployment of the sprinklers.

Exemplary embodiments may utilize smoke and/or heat detectors or other suitable sensing devices and systems, to sense a probable fire condition before the blaze becomes too intense. The smoke/heat detectors activate one or more valves which cause water or other suppression fluid to flow through the pipes. In this initial condition, the sprinklers may remain closed and the water may be discharged at a remote location away from the protected area. If the heat intensity reaches a threshold level, one or more sprinklers may deploy in response to the fire.

It is thus an object of exemplary embodiments to provide a fire sprinkler system in which one or more signals generated by a heat, smoke, radiation or other sensors cause activation of a fluid flow control valve, which in turn initiates fluid flow so that fluid flows through the sprinkler line before an incipient fire situation becomes a threshold thermal event causing one or more sprinklers to deploy.

It is a further object of exemplary embodiments to provide a fluid control valve arrangement that operates as the test inspector's connection in the sprinkler line.

These, as well as other objects of exemplary embodiments will become apparent upon consideration of the following detailed description and drawings.

BEST MODE FOR CARRYING OUT INVENTION

Figure 1:
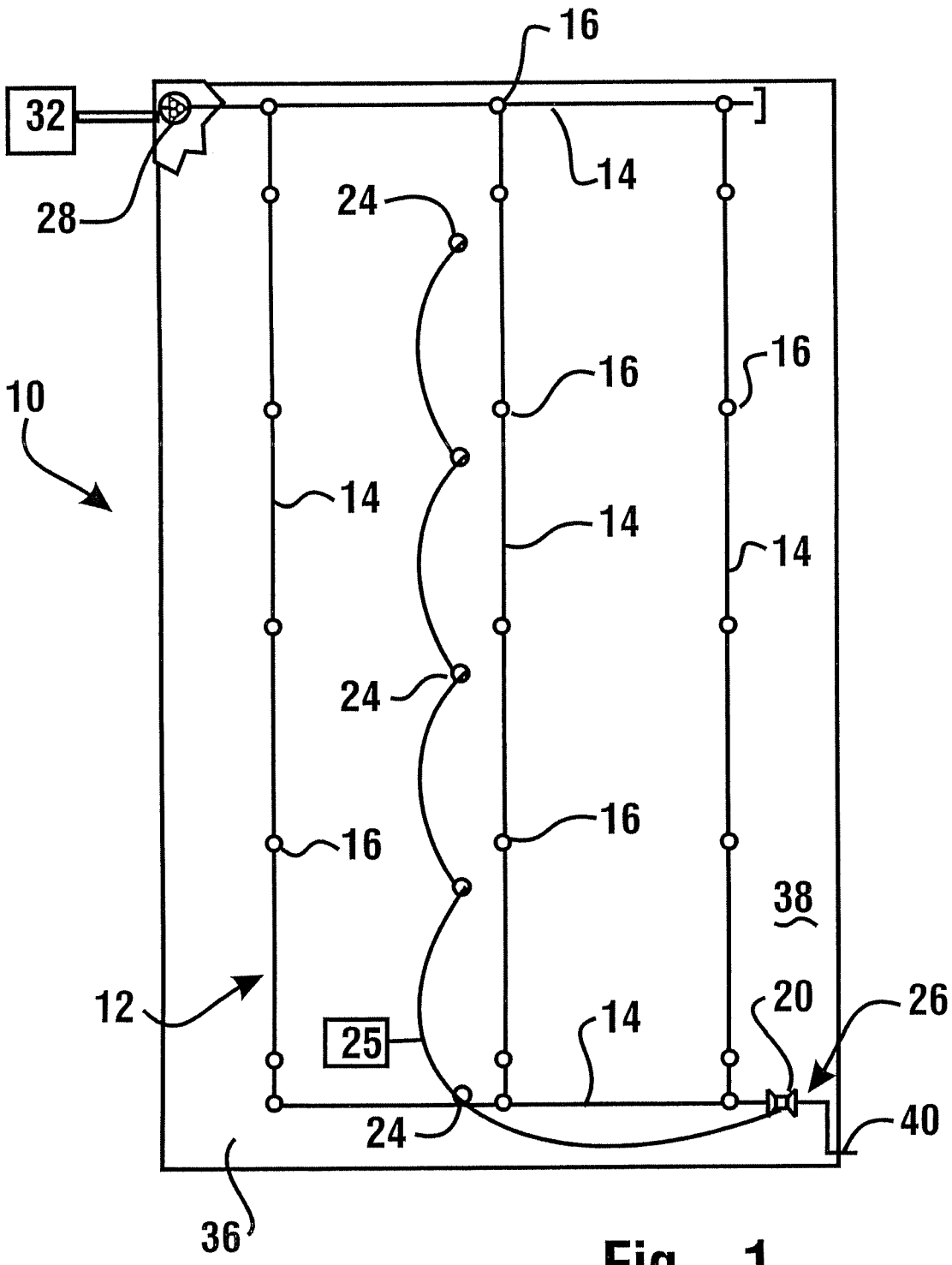
FIG. 1 is a schematic representation of a top view of an exemplary fire suppression system.
Figure 2:
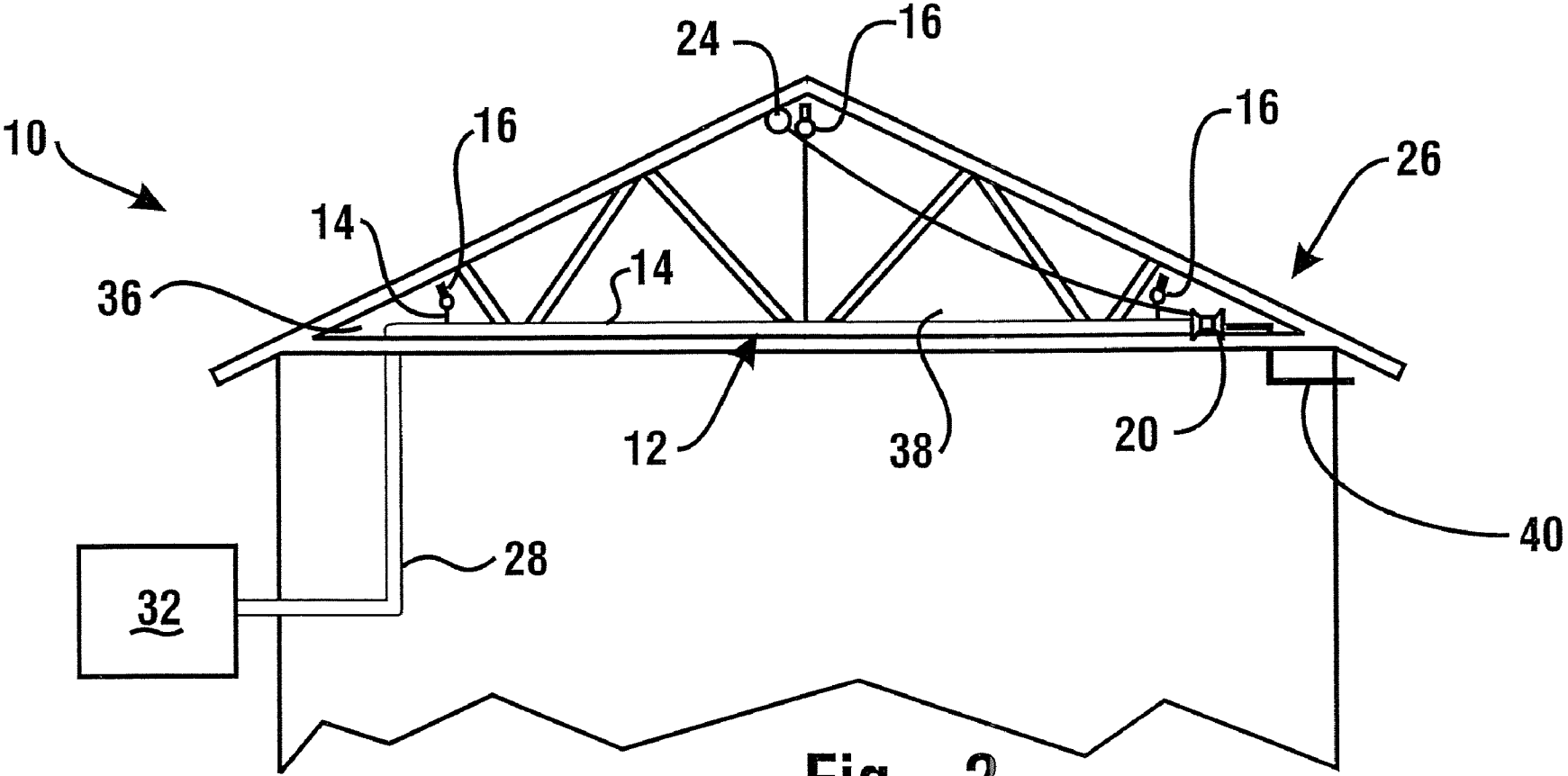
FIG. 2 is a schematic representation of a side view of the exemplary fire suppression system.

The foregoing summary, as well as the following detailed description of exemplary embodiments, will be better understood when read in conjunction with the appended drawings. For the purpose of illustrating the exemplary embodiments, there is shown in the drawings certain exemplary systems. It should be understood, however, that these embodiments are merely exemplary and that the present invention is not limited to the systems, arrangements and instrumentalities shown or described herein.

With respect to the Figures, in an exemplary embodiment, a fire suppression system 10 includes a sprinkler line 12 comprising a network of fluid conduits 14 which are formed of a thermoplastic material. In the exemplary embodiment, the fluid conduits are comprised of chlorinated polyvinyl chloride (CPVC). The fluid conduits (which are alternatively referred to herein as pipes) 14 are in flow communication with a plurality of fire sprinklers 16. The exemplary type of CPVC resin of which the pipes are comprised is sold under the BLAZEMASTER® brand name. An exemplary CPVC composition has physical and thermal characteristics as follows:

| Property | BLAZEMASTER ® Brand CPVC | ASTM |
|---|---|---|
| Specific Gravity, "Sp. Gr." | 1.55 | D792 |
| IZOD Impact Strength (ft-lb./inch notched) | 1.5 | D256A |
| Modulus of Elasticity, @73EF psi, "E" | $4.23 \times 10^5$ | D638 |
| Compressive Strength, psi, "o" | 9,600 | D695 |
| Poisson's Ratio, "O" | .35-.38 | — |
| Working Stress @ 73EF, psi, "S" | 2,000 | D1598 |
| Hazen Williams Factor "C" | 150 | — |
| Coefficient of Linear Expansion, in/(in E F), "e" | $3.4 \times 10^{-5}$ | D696 |
| Thermal Conductivity, BTU/hr/ft$^2$/EF/in, "k" | 0.95 | D177 |
| Flash Ignition Temperature, EF | 900 | D1929 |
| Limiting Oxygen Index, "LOI" | % 60 | D2863 |
| Electrical Conductivity | Non Conductor | — |
| Extrusion Temperature | 414-425° F. (approx.) | N/A |
| Heat Distortion Temperature, EF | 217 | — |

The exemplary system 10 includes at least one control valve 20 operative to control flow of water or other fire suppression fluid in the sprinkler line 12. In the exemplary system, the control valve is an electrically activated solenoid control valve. However, in other embodiments, other types of control valves such as electrically, pneumatically or mechanically actuated fluid flow control valves may be used. The exemplary system also includes one or more sensors 24 (which are alternatively referred to herein as detectors) which operate independently of a condition of the sprinklers 16. The sensors 24 operate to detect one or more conditions that correspond to existence of combustion and/or a probable nearby fire. The sensors 24 may be operative to sense temperature level, flame, smoke, infrared radiation, ultraviolet radiation, rate of temperature change, or other characteristics of a combustion activity amenable to detection. The sensors 24 may also comprise ionization detectors. In the exemplary embodiment, the sensor 24 is operative to generate at least one electric signal in response to the detection of at least one characteristic associated with a probable fire. Of course, these approaches are exemplary.

In an initial condition of the exemplary sprinkler line 12, its included piping 14 may be generally fully filled with fire suppression fluid. Air bleeding from the conduits may be used in enabling the sprinkler line 12 to achieve the fluid-filled condition. The sprinkler line 12 can be in fluid connection with one or more vents or valves at suitable locations for the purpose of bleeding air pockets therefrom. The control valve 20 may also be used in the exemplary embodiment in removing air from the sprinkler line 12.

In the exemplary embodiment, the electric signals from the sensor are received by the solenoid control valve 20. Although the schematic representation of system 10 shows a direct connection between sensors 24 and solenoid control valve 20, other arrangements and connections may be used. For example, the sensor may generate an electric signal that is routed to circuitry such as an electronic control board, which may include processors, relays or other devices, from which a responsive signal is sent to the solenoid valve 20. Alternatively, a low volume or amperage signal from one or more sensors may be amplified through suitable circuitry to activate the valve. In still other embodiments, signals from the at least one sensor corresponding to at least one condition that corresponds to a probable fire may be converted to signals that can be processed and analyzed through operation of circuitry. Such circuitry may include, for example, analog to digital converter and at least one processor. The at least one processor may control the opening and/or closing of the valve through a suitable interface. In some embodiments, such circuitry may be included in the sensors and/or the valves, and in other embodiments the circuitry may be included in separate components. The signals from one or more sensors may also trigger other devices such as a fire alarm, schematically represented as 25, or other audible warning sound. In some embodiments, the solenoid control valve 20 can be opened upon receiving wired or wireless signals responsive to signals generated by the sensors 24 (or other device associated with the sensors). Of course, these approaches are exemplary.

In an exemplary embodiment, the solenoid control valve 20 may be disposed at a remote location 26 and in fluid connection with the sprinkler line 12. The solenoid control valve 20 may be included as part of an inspector's test connection for the portion of the sprinkler system. The inspector's test connection may be used to test fluid flow through the system in the theoretical "worst case" when the most remote sprinkler from the inlet connection in the sprinkler line deploys in response to a fire condition. The inspector's test connection can be used to evaluate the flow rate of fire suppression fluid at the most remote region of the sprinkler line.

In the exemplary embodiment, the sprinkler line 12 includes a supply riser 28 fluidly extending between a fluid source 32 and the sprinkler line 12. The fluid source may comprise in some embodiments a connection to a pressurized city water supply pipe. In other embodiments, it may include a connection to a water tower or the like. The exemplary source 32 of fluid is under pressure that causes fluid to move therefrom into the sprinkler line 12 whenever an outlet is opened. This may include fluid flow from a deployed sprinkler head and/or flow through the control valve.

Upon detection of an incipient fire situation, sensor 24 generates at least one electric signal that causes the solenoid control valve 20 to change from its normally closed condition to an open condition. As used herein, the term "incipient fire situation" denotes the beginning stage of a fire or other thermal or fire event that is detectable by the sensors, but which is not fully developed so as to cause the structural failure of one or more thermoplastic fluid conduits due to heat and/or flame. Such failure to be avoided generally involves the breakdown of a thermoplastic conduit so as to cause fluid leakage therefrom through an opening other than through a sprinkler head. An incipient fire situation may be detected by sensing conditions such as the release of smoke, thermal energy or detectable ultraviolet radiation, or other associated conditions.

Activation of the solenoid control valve 20 of the exemplary embodiment initiates a flow event so that fluid flows through the network of fluid conduits 14. Fluid pressure causes the fire suppression fluid to move from the source 32 and through the fluid conduits 14. As is readily appreciated, the sprinkler line 12 is changed from an initial condition (the control valve 20 being closed) wherein fluid within the conduits is generally stationary, to a secondary condition (the control valve 20 being open) wherein fluid within the conduits is flowing. In the secondary condition, fluid can flow from the fluid source 32, through the network of fluid conduits 14, through the control valve 20, and be discharged through an outlet 40. The flowing fluid provides a cooling effect which may prolong the structural integrity of the fluid conduits 14 as compared to fluid conduits kept in the initial stationary condition. Thus, in the exemplary embodiment, the flowing fluid acts as a cooling agent, avoids hot spots that might be a point of failure, and improves performance of the fluid conduits 14 if the incipient fire situation escalates into a greater thermal event.

In the exemplary embodiment, the term threshold thermal event refers to a thermal event that causes one or more sprinklers 16 to deploy and dispense fire suppression fluid. In exemplary embodiments, the fire suppression fluid is water but in other embodiments may comprise other fluids and mixtures that have fire suppression or extinguishing properties. In an exemplary arrangement, a sprinkler 16 is an "automatic sprinkler" which is a sprinkler type which is normally in a closed condition due to the presence or condition of a thermally-responsive member at temperatures that do not correspond to an adjacent fire. Upon exposure to a threshold thermal event, the thermally-responsive member melts or otherwise changes its condition to cause the sprinkler to open and distribute fire suppression fluid. Exemplary sprinklers are constructed to open at a predetermined temperature. The specific construction of the exemplary automatic sprinkler 16 used does not form a part of the present invention. In some embodiments, commercially available sprinklers that deploy upon thermal activation may be utilized.

Installation of fire sprinkler systems must conform to certain testing standards. The standards sometimes vary depending upon factors such as use or type of structure and location of the system. It is believed that fire sprinkler systems applying the principles described herein are enabled to meet or exceed the requirements for wet pipe systems in attic installations. Additionally, it is also believed that fire sprinkler systems applying the principles described herein are enabled to meet or exceed the requirements for wet pipe systems in residential unfinished basement installations.

In the exemplary embodiment, the fire suppression fluid comprises water, although as previously noted the principles described may also be applied to other materials that can be used to suppress and/or extinguish fire conditions. In the exemplary embodiment, the water and the associated pressure act as an agent to retain the structural integrity of the fluid conduits 14 in the time interval between initial detection of a possible fire situation, and the time one or more sprinklers are deployed.

The exemplary embodiments may be particularly useful if the incipient fire situation occurs in an eave 36 (or other location) of an area 38 (e.g., a building attic) which is not directly in a fluid distribution path of any of the sprinklers 16. The incipient fire situation could still be detected by a fire sensor 24 in order to activate the solenoid control valve 20, especially when the fire detector 24 is located adjacent the eave 36 or located in a peak of the attic where heat and/or smoke is likely to accumulate. The exemplary solenoid control valve 20 is operative to cause fire suppression fluid to flow through the sprinkler line 12. The flow of the fluid in the sprinkler line allows the fluid conduits 14 to retain structural integrity in case the incipient situation matures into a threshold thermal event. If a threshold thermal event is reached, then one or more of the sprinklers 16 automatically deploy to distribute extinguishing fluid from the sprinkler line to the area of the fire.

The exemplary system 10 includes an outlet 40 which is fluidly downstream of the fluid control valve 20. The outlet 40 allows discharge of flowing fire suppression fluid. Opening valve 20 before (or without) any sprinkler 16 activation enables fluid to be released from the sprinkler line 12 in order to sustain fluid flow. For example, if an incipient fire situation initiates fluid flow in the fluid conduits 14 but the situation does not mature into a threshold thermal event, then no sprinklers will be deployed. In such a situation, fluid will flow out of the sprinkler line 12 through the outlet 40. The outlet 40 may also be employed for other purposes, such as to test the system, to drain the system after use, or to return the sprinkler line to an initial condition. The exemplary system may also be drained through the riser 28 back toward the fluid source 32.

It is probable that in a sprinkler system without the sensors 24 of the exemplary embodiment, a fire in an eave would be undetected until an area adjacent one or more of the sprinklers were hot enough to cause the sprinkler to deploy, causing additional fluid to enter the sprinkler line. However, the first deployed sprinkler may be remotely located from the fire. For example, the sprinkler may deploy in a peak of the attic where heat and smoke would naturally accumulate. By the time a sprinkler directly above the growing fire would be hot enough to deploy, the fire event may be capable of causing structural damage to the fluid conduits that are used to deliver fluid to that sprinkler. Further, the fluid flow through other deployed sprinklers combined with a conduit failure may result in insufficient flow to contain the fire. However, in operation of the exemplary embodiment, fluid would be flowing through the conduits 14 upon detection of the incipient fire situation so as to enable the conduits to withstand exposure to the threshold thermal event without structural failure. That is, cooling fluid would still be flowing through the (structurally sound) conduits 14 before the sprinkler above the fire deployed. The flow of cooling fluid therethrough enables a conduit 14 to be resistant to structural failure/collapse due to heat or flame for a longer period of time (than without the fluid flow).

In an exemplary arrangement of the system 10, the sprinkler line 12 comprises a "wet" network of fluid-containing conduits 14 formed of CPVC. That is, in the initial condition the exemplary sprinkler line 12 is not "dry." When the sprinkler line 12 is in the initial condition, the fire extinguishing fluid in the conduits 14 is substantially stationary. When the sprinkler line 12 is in a secondary (or active) condition, the fluid conduits 14 contain flowing fluid. Because of the flowing fluid, the fluid conduits 14 are able to withstand more prolonged exposure to a threshold thermal event before structural failure thereof. The additional time during which structural integrity is maintained which is provided by the exemplary arrangement, enhances the probability of the sprinklers successfully receiving and discharging fire suppression fluid.

In the exemplary arrangement, a flow member in the flow control valve changes condition to initiate a flow event whereby fire extinguishing fluid selectively flows from the source 32 of a fire extinguishing fluid through the sprinkler line 12, to change the sprinkler line from the initial condition to the secondary condition. The exemplary flow member may be in exemplary embodiments, a gate or ball member within the solenoid control valve 20. The solenoid control valve 20 of the exemplary embodiment is disposed at a remote location from the sprinkler line, such as at a downstream location away from the areas where fluid discharges from any of the sprinklers. The fluid source 32 provides fluid under positive pressure in an operative state. The positive pressure can be used to enhance the flow of fluid through the sprinkler line 12. For example, in exemplary embodiments with the sprinkler line 12 located in a house or other building attic, the fluid source may be a connection to the house drinking water system. The fluid source can be supplied from a public water system that delivers water to the house, with the water being delivered at positive pressure. Alternatively, in some embodiments, the fluid source can be an on site water holding tank devoted to the fire suppression system. The tank can be pressurized to supply water from the tank to the sprinkler line 12, or alternatively a pump can be used, or the tank can be elevated to provide gravity flow of water therefrom. Of course, these approaches are exemplary and other fluid source arrangements may also be employed.

In an exemplary arrangement, one or more detectors detect an incipient fire situation and causes activation of the solenoid control valve 20. The exemplary detectors may include one or more sensing devices 24 operative to sense heat, smoke, infrared radiation, ultraviolet radiation, any combination thereof, or other properties associated with a nearby fire. The one or more sensing devices 24 are operative to provide at least one electrical signal in response to sensing the incipient fire situation. In addition, the devices 24 may be operative to cause operatively connected circuitry to trigger a fire alarm 25 or other warning. In the exemplary arrangement, the solenoid control valve 20 is activated, directly or indirectly, responsive to the electrical signals provided by the one or more sensing devices 24.

In exemplary embodiments, the one or more sensing devices 24 may be hard-wired to the control valve 20. In some embodiments, all of the detectors 24 may be connected to the control valve 20 via a single electrical connection. Alternatively, each detector 24 may be individually connected to the control valve 20 via its own separate connection and/or respective dedicated electrical line. Also, in some embodiments, the control valve 20 may be arranged (with the detectors 24) to be either tripped in response to electricity (via an electrical line) or in response to the absence of electricity, or other signals.

In other exemplary arrangements, the detectors 24 may be connected (either directly or indirectly) to the control valve 20 via wireless signals which cause the control valve to be opened. For example, radio frequency (RF), radio frequency identification (RFID), and infrared (IR) may be used to enable a detector 24 (upon detection of a fire symptom) to wirelessly communicate the existence of at least one condition leading to opening of the control valve 20. Each of detectors 24 can have an RF transmitter and the control valve 20 have an RF receiver which is able to receive a valve-opening RFID signal transmitted from any of the detectors 24.

Furthermore, the detectors 24 and the control valve 20 can be connected (e.g., plugged in) to the same electrical supply system. The electrical system can be used to enable a detector 24 to communicate a fire symptom signal to the circuitry controlling the condition of the control valve 20. Each sensor 24 can generate a network signal and cause the signal to be delivered into the electrical supply system. This may be done, for example, using the X-10 communication protocol. The control valve circuitry is able to detect or recognize the inserted network signal in the electrical supply. Upon detection of the detector's signal, the control valve is operated to open. Thus, in such embodiments, no direct wiring from a detector 24 to the flow control valve 20 may be needed.

The exemplary arrangement may include a plurality of initially closed sprinklers 16 that are operative, when deployed, to distribute fire suppression fluid from the sprinkler line 12 to a region to be protected. Each sprinkler 16 may include a thermally responsive member operative to open the sprinkler upon exposure to a threshold thermal event. The region to be protected may include an area 38 such as an attic. Alternately, a similar system may be used in other areas, such as a basement area, an inaccessible blind space, a plenum, and areas where fire protection is desirable.

In an exemplary arrangement, when the sprinkler line 12 is in the initial condition, the fluid conduits 14 already hold fire extinguishing fluid. The initial fluid held in the conduits is substantially stationary or non-moving. Activation of the flow valve 20 initiates a flow event that causes fluid to change from its stationary condition and begin to flow within the fluid conduits 14. Flowing fluid can exit the sprinkler line 12 and pass through the sprinkler line outlet 40. Incoming fluid enters the sprinkler line 12 from the fluid source 32 via the sprinkler line inlet 28 as fluid passes from the outlet.

In an exemplary arrangement, the network of fluid conduits can be "looped", meaning that there are no dead-end branches. Thus, no matter where a small fire might start, triggering of the solenoid control valve 20 can cause fluid to flow through each fluid conduit, thus prolonging the structural integrity of each fluid conduit in the network.

In another exemplary arrangement, the valve 20 may be selectively closed and opened responsive to conditions sensed by one or more sensors. The valve 20 can be in operative connection with one or more of the sprinklers 16, enabling the circuitry controlling the valve member to receive signals indicative of respective sprinkler conditions. The valve 20 may be caused to close upon activation of one or more of the sprinkler members 16. With the valve 20 closed, then more fluid may be sent through the sprinklers 16 instead of passing through the outlet 40. The valve 20 may be selectively controlled through operation of at least one processor based on control logic. For example, the valve 20 may be operatively held in a closed condition unless no activation signal has been received from a sprinkler 16 and no signals corresponding to a fire are being received from a sensor 24. That is, only with simultaneous sensor activation and sprinkler non-activation is the flow control valve 20 open. In some embodiments, the valve 20 may receive a reset control signal. Such a signal may be operative to cause the valve to close, which will assure maximum fluid flow through the deployed sprinklers. An override control signal or switch may also be used to open the valve 20 for system draining or maintenance. Other valve/sensor/sprinkler relationship arrangements may also be employed in exemplary embodiments.

In other exemplary embodiments, the at least one detector may be in operative connection with circuitry that includes a processor. The at least one processor may execute computer executable instructions for purposes of operating the control valve and/or other devices connected to the system. For example, in some embodiments, the at least one processor may control the condition of the control valve so that it is selectively opened to a controlled extent and/or re-closed after opening. For example, the at least one processor may determine that conditions as sensed by the detectors indicate that less than full flow is needed in order to maintain sufficient flow in the conduit to retain the structural integrity thereof. In such circumstances, the control valve may be controlled to open to provide less than full flow. Further, some exemplary embodiments may include one or more pressure sensors in one or more fluid conduits. The pressure sensors may be in operative connection with the at least one processor. The at least one processor may operate responsive to the pressure signals to determine that one or more sprinklers has deployed, and/or other conditions have occurred. In response to sensing such conditions, the condition of the control valve may be changed responsive to operation of the at least one processor. This may include changing the condition of the control valve toward the closed position to provide greater water pressure for the deployed sprinkler heads. Of course, these approaches are exemplary.

In still other embodiments, a plurality of control valves may be used, each in connection with various sprinkler runs or zones of the system. The at least one processor may operate to control each control valve in accordance with conditions as sensed by one or more detectors and the programming associated with the at least one processor. For example, responsive to sensing a probable fire condition in a hot spot, such as by sensing an elevated temperature near the peak of a roof, the at least one processor may start fluid flow in the conduits that are disposed away from the peak by opening, either fully or partially, the associated control valves. In some exemplary embodiments, the conduits to sprinklers near the peak may be maintained with no or little flow through operation of the associated control valves. In this way, unnecessary flow through conduits directly connected to sprinklers that will open before damage to the conduits occurs, is reduced. This may provide for more effective cooling action where it is needed.

In still other exemplary embodiments, a plurality of sensors may be in operative connection with the at least one processor. The at least one processor may be programmed to determine, based on one or more sensor readings and/or the timing thereof, the probable area of the fire. This may include for example, processing signals from a plurality of temperature and/or smoke sensors to determine a probable location of the area of initial combustion. The at least one processor may then cause one or more control valves to open to the extent necessary to provide fluid flow through conduits in areas where the fire appears to be growing but the temperature riot yet risen to the extent necessary to activate the sprinklers. Alternatively, or in addition, the at least one processor may operate to control flow as desirable to deliver fire suppression fluid to the fire source once one or more sprinklers are activated. This may include, for example, opening and closing the control valves to provide higher water pressure in conduits with deployed sprinklers that are closest to the origin of the fire as determined through operation of the at least one processor. Of course, these approaches are exemplary, and in other embodiments other approaches may be used.

In other exemplary arrangements, the fluid conduits 14 may be insulated. Piping insulation may be attached or applied to the exterior of the pipes 14. The insulation can serve a dual purpose of providing protection to the pipes from cold (freezing temperatures) and heat and flame (from a fire). Also, insulating material may be built into the pipes. A pipe may also have an insulating layer embedded at an exterior surface thereof. A pipe may also be multi-layered, such as a pipe within one or more pipes. Insulation can be provided in one of the exterior layers. Similarly, fluid can be passed through separate fluid conduits in an exterior layer or section. Also, some sections of the sprinkler line 12 may be insulated while other sections are free of insulation (or less insulated). Of course, these approaches are exemplary.

In other exemplary arrangements, for example, systems deployed in colder climates, the fluid may be circulated (without detection of a fire symptom) through the sprinkler line 12 and returned (via a recycle valve and additional piping) to the fluid source 32, such as a holding tank. The flow of the fluid can reduce the likelihood of fluid freezing in the sprinkler line 12. The fluid source may also contain heated fluid. The recycle valve could be temperature controlled. The recycle valve (if open) would be caused to close upon sensor 24 detection of a fire symptom. Other arrangements may also be employed, including the use of anti-freezing fluid or additives. Of course, these approaches are exemplary.

Thus, the systems and methods of the exemplary embodiments achieve at least one of the above stated objectives, eliminate difficulties encountered in the use of prior devices and arrangements, solve problems, and attain the desirable results described herein.

In the foregoing description, certain terms have been used for brevity, clarity and understanding, however, no unnecessary limitations are to be implied therefrom because such terms are for descriptive purposes and are intended to be broadly construed. Moreover, the descriptions and illustrations herein are by way of examples and the invention is not limited to the details shown and described. It is to be understood that various modifications and enhancements may be made without departing from the spirit and scope of the inventive principles described herein.

Further, in the following claims, any feature that is described as a means for performing a function shall be construed as encompassing any means capable of performing that function and shall not be limited to the particular means shown in the foregoing description or mere equivalents.

Having described the features, discoveries, and principles of the invention, the manner in which it is constructed and operated, and the useful results attained; the new and useful structures, devices, elements, arrangements, parts, combinations, systems, equipment, operations, methods, and relationships are set forth in the appended claims.

What is claimed is:

1. Apparatus comprising:

a fire suppression arrangement, wherein the arrangement includes at least one fire detector, wherein the at least one fire detector is operative to detect at least one condition corresponding to a fire, wherein the arrangement includes a sprinkler line having an inlet, wherein the sprinkler line includes at least one conduit comprising a thermoplastic composition, fire suppression fluid in the at least one conduit, fire suppression fluid source, at least one thermally-activated sprinkler, at least one flow control valve, and a predetermined fluid outlet disposed separately from all of the at least one sprinkler wherein said at least one sprinkler has an outlet, wherein the at least one flow control valve is in operative connection with the at least one fire detector, wherein the at least one flow control valve is closed when the at least one condition is not detected, and wherein the at least one flow control valve is operative to open responsive to detection of the at least one condition by the at least one fire detector, wherein said fire detector is operative to cause an electrical signal to be generated, wherein said electrical signal from said fire detector is received by said flow control valve and said electrical signal causes said flow control valve to change from its normally closed condition to an open condition, wherein the at least one open flow control valve also causes fluid flow from the source into the sprinkler line through the inlet, wherein opening of the at least one flow control valve causes fluid to flow through the sprinkler line and through said separately disposed outlet, prior to activation of said thermally-activated sprinkler: and wherein the at least one fire detector is positioned relative to the at least one sprinkler, such that the at least one fire detector is operative to detect the at least one condition prior to activation of any of the at least one sprinkler.

2. The apparatus according to claim 1 wherein the arrangement is located in a building attic.

3. The apparatus according to claim 2 wherein the fluid source is external to the attic.

4. The apparatus according to claim 2 wherein the attic includes a first area not directly in a distribution path of any of the at least one sprinkler, and wherein the at least one fire detector is operative to sense the at least one condition in the first area.

5. The apparatus according to claim 1 wherein the at least one flow control valve comprises a solenoid control valve, wherein the at least one fire detector is operative to provide at least one electrical signal responsive to detection of the at least one condition, and wherein the at least one signal is operative to cause activation of the solenoid control valve.

6. The apparatus according to claim 5 wherein the solenoid control valve is disposed at a location in the sprinkler line remote from the fluid source and is disposed upstream from and adjacent to the outlet.

7. The apparatus according to claim 6 wherein the thermoplastic composition comprises chlorinated polyvinyl chloride (CPVC).

8. The apparatus according to claim 7 wherein the at least one fire detector is operative to cause fire suppression fluid flow in the at least one conduit prior to the at least one conduit leaking fire suppression fluid.

9. The apparatus according to claim 8 and further comprising at least one processor and at least one sensor, wherein the at least one processor is in operative connection with the at least one sensor and the control valve, and wherein the control valve is operative to open and close responsive to operation of the at least one processor.

10. The apparatus according to claim 1 wherein the thermoplastic composition comprises chlorinated polyvinyl chloride (CPVC).

11. The apparatus according to claim 1 wherein the flow control valve is operative to cause flow through the at least one conduit prior to the at least one conduit leaking fire suppression fluid due to failure caused by at least one of heat and flame.

12. The apparatus according to claim 1, and further comprising at least one processor, wherein the at least one processor is in operative connection with the at least one fire detector and the at least one flow control valve, and wherein the at least one flow control valve is caused to open and close responsive to operation of the at least one processor.

13. A method comprising:

(a) providing a flow control valve in operative connection with at least one fire detector, wherein said fire detector generates an electrical signal and wherein said electrical signal is received by said flow control valve, wherein the at least one fire detector causes the flow control valve to open responsive to detection of at least one condition corresponding to a fire by the at least one fire detector, wherein a fire suppression sprinkler line includes the flow control valve, at least one fluid conduit comprising a thermoplastic composition, at least one thermally-activated sprinkler, an inlet, and a predetermined fluid outlet disposed separately from all of the at least one thermally activated sprinkler, wherein said at least one thermally activated sprinkler has an outlet; and wherein opening of the flow control valve causes fluid to flow out of the sprinkler line and through the said separately disposed outlet prior to activation of said thermally activated sprinkler; and (b) arranging the at least one fire detector relative to the at least one thermally activated sprinkler, wherein the at least one fire detector is operative to detect the at least one condition prior to activation of any of the at least one thermally activated sprinkler.

14. The method according to claim 13 wherein the sprinkler line includes an inlet, wherein step (a) includes connecting the inlet and a fire suppression fluid source, and wherein opening of the flow control valve also causes fluid to flow from the source into the sprinkler line through the inlet.

15. The method according to claim 14 wherein the flow control valve comprises a solenoid control valve, wherein the at least one fire detector is operative to provide at least one electrical signal responsive to detection of the at least one condition, wherein the at least one electrical signal is operative to cause activation of the solenoid control valve, and wherein step (a) includes operatively connecting the solenoid control valve and the at least one fire detector.

16. The method according to claim 15 wherein the solenoid control valve is disposed at a location in fluid communication with the sprinkler line, remote from the fluid source and disposed upstream from and adjacent to the outlet, and further comprising:

(c) testing fluid flow through the sprinkler line via the solenoid control valve.

17. The method according to claim 13 wherein the sprinkler line includes fire suppression fluid in the at least one fluid conduit, wherein the thermoplastic composition comprises chlorinated polyvinyl chloride (CPVC), and wherein step (b) includes positioning the at least one fire detector to cause detection of the at least one condition prior to any of the at least one conduit leaking fire suppression fluid.

18. The method according to claim 17, and further comprising:

(d) opening and closing the flow control valve responsive to operation of at least one processor, wherein the at least one processor is in operative connection with the at least one fire detector and the flow control valve.

19. A method comprising:

(a) sensing at least one condition corresponding to a fire with at least on fire detector, wherein the at least one fire detector is operative to provide at least one signal responsive to such sensing;

(b) responsive to sensing at least one condition in step (a), providing at least one signal responsive to operation of the at least one fire detector;

(c) responsive to providing the at least one signal in step (b), causing the automatic opening of a flow control valve in fluid connection with a fire suppression sprinkler line, wherein the sprinkler line is in fluid communication with a fluid inlet and a fluid outlet, and includes at least one conduit comprising a chlorinated polyvinyl chloride (CPVC) composition, and at least one thermally-activated sprinkler, wherein the fluid outlet is disposed separately from an outlet of all the at least one thermally-activated sprinkler, wherein opening of the fluid control valve causes both fluid flow into the sprinkler line through the inlet and fluid out of the sprinkler line and through said separately disposed outlet prior to activation of said thermally-activated sprinkler; and (d) subsequent to step (c), automatically activating the at least one sprinkler responsive to thermal exposure thereof to a fire, wherein activation of the at least one thermally-activated sprinkler causes fluid from the sprinkler line to be discharged through the at least one thermally-activated sprinkler outlet.

20. The method according to claim 19 and further comprising:

(e) prior to step (a), delivering fire suppression fluid from a fire suppression fluid source into the sprinkler line through the inlet;

wherein prior to the opening of the flow control valve in step (c), the sprinkler line includes substantially stationary fire suppression fluid therein.

21. The method according to claim 20 wherein step (d) includes activating the at least one sprinkler prior to any of the at least one conduit of the sprinkler line leaking fire suppression fluid.

22. The method according to claim 21 and further comprising:

(f) subsequent to step (b) and prior to step (d), releasing from the sprinkler line through the said separately disposed outlet, fire suppression fluid delivered into the sprinkler line in step (e); and (g) prior to step (d), replacing fire suppression fluid released from the sprinkler line in step (f) with additional fluid from the source through the inlet;

wherein steps (f) and (g) occur concurrently.

23. The method according to claim 22 wherein the flow control valve comprises a solenoid control valve, wherein the solenoid control valve is in operative connection with the at least one fire detector, wherein step (b) includes operating the at least one fire detector to cause to be produced at least one electrical signal, and wherein step (c) includes receiving the at least one electrical signal produced in step (b) with the solenoid control valve.

24. The method according to claim 23 wherein the steps (a)-(d) are carried out in an attic of a building.

25. The method according to claim 23 wherein step (b) includes operating at least one processor to cause the at least one electrical signal to be produced, wherein the at least one electrical signal is produced responsive to sensing the at least one condition with the at least one fire detector.

26. The method according to claim 25 wherein in step (c) the at least one processor is operative to cause the flow control valve to open and close.

* * * * *